United States Patent [19]

Colvin

[11] Patent Number: 4,934,451

[45] Date of Patent: Jun. 19, 1990

[54] APPARATUS AND METHOD FOR CONDITIONING AIR

[76] Inventor: James R. Colvin, 7111 Crestmont, Houston, Tex. 77033

[21] Appl. No.: 346,125

[22] Filed: May 1, 1989

[51] Int. Cl.[5] ..... F25B 29/00

[52] U.S. Cl. ..... 165/2; 165/48.1; 165/909; 62/95; 62/272; 237/8 R; 122/20 B

[58] Field of Search ..... 165/48.1, 909, 2; 62/272, 95; 237/8 R; 122/20 B

[56] References Cited

U.S. PATENT DOCUMENTS

| | | | |
|---|---|---|---|
| 2,146,483 | 2/1939 | Philipp | 62/95 |
| 2,259,541 | 10/1941 | Ballard | 62/95 |
| 2,686,406 | 8/1954 | Pessoa | 62/272 |
| 3,521,459 | 7/1970 | Rath | 62/91 |
| 3,552,135 | 1/1971 | Peavler | 62/98 |
| 4,240,499 | 12/1980 | Kals | 165/909 |
| 4,344,568 | 8/1982 | Stewart et al. | 165/909 |
| 4,380,910 | 4/1983 | Hood et al. | 62/95 |
| 4,392,610 | 7/1983 | Moskal | 165/909 |
| 4,759,195 | 7/1988 | Biancardi | 62/272 |

FOREIGN PATENT DOCUMENTS

| | | | |
|---|---|---|---|
| 3112069 | 10/1982 | Fed. Rep. of Germany | 165/909 |
| 0147939 | 8/1984 | Japan | 62/279 |

*Primary Examiner*—John Ford

*Attorney, Agent, or Firm*—David M. Ostfeld

[57] ABSTRACT

An apparatus and method for conditioning air is disclosed. The invention captures condensation from an evaporator coil and pumps the chilled condensation through a coil to precool the air before the air flows over the evaporator coil. During a heating cycle, the invention captures waste heat from the furnace with a radiator system which includes through the coil to warm the air as it flows through the air handling unit.

28 Claims, 3 Drawing Sheets

APPARATUS AND METHOD FOR CONDITIONING AIR

FIELD OF THE INVENTION

The present invention relates to a system for increasing the efficiency of conventional heating and cooling systems, more particularly, the present invention relates to an apparatus and method which recycles waste product from heating and cooling systems.

BACKGROUND OF THE INVENTION

Heating, ventilation, and air conditioning systems (HVAC) are used in commercial and residential buildings to condition the air to a desired temperature. HVAC systems typically utilize an air handling unit which comprises a furnace for heating the air, an evaporator coil connected to an exterior condensing unit for cooling the air, and a transition duct for connecting the furnace to the evaporator. A blower fan draws air from a return vent in the structure and pushes the air past the furnace and evaporator coil. In a heating cycle, the air is heated as it passes over a heat exchanger in the furnace. In a cooling cycle, the air is chilled as it passes over the evaporator coil.

In a conventional gas furnace, the heat is generated by main burners which are fired to heat a sealed heat exchanger. The exhaust gases from the combustion process are then vented through flue pipe and out of the structure. As the air is blown over the heat exchanger, the air is heated and is then distributed in a duct system through the structure.

In a conventional air conditioning system, a condensing unit is located outside of the structure to condense the working fluid in the system. Heat generated during the compression of the fluid is released to the atmosphere, and the compressed fluid is then pumped to the evaporator coil. The compressed fluid cools as it expands and flows through the evaporator coil, and this change in enthalpy chills the air as it is blown over the exterior surface of the evaporator coil. As this occurs, humidity in the air condenses o the exterior surface of the evaporator coil and is collected by a drain pan which carries the condensation away from the evaporator coil. This condensation is typically drained to a waste plumbing line or to a point outside of the structure.

Conventional heating and cooling systems lose efficiency because excess heat from the furnace is vented to the ambient surroundings, and energy is expended in the condensation of water on an evaporator coil. A need, therefore exists for an air conditioning system which improves the efficiency of heating and cooling systems.

SUMMARY OF THE INVENTION

The present invention provides an apparatus and method which improves the operating efficiency of heating and cooling systems which include an evaporator coil, a heat exchanger, and a fan for moving air over the evaporator coil and heat exchanger. The invention comprises a coil having an exterior surface in contact with the moving air, a fluid collection system for collecting condensation from the evaporator coil and for selectively pumping the condensation through said coil, and a radiator system adjacent to the heat exchanger for heating a fluid and for selectively pumping the heated fluid through said coil. In other embodiments of the invention, a first and second valve can be operated to alternatively control the movement of the condensation and the heated fluid through the coil, a level control can be utilized to detect the depth of condensation in the fluid collection system, and a fluid diverting system can be used to selectively divert condensation from the coil and into the fluid collection system.

The method of the invention is practiced by collecting the condensation during the cooling cycle and by pumping the condensation through the coil. During the heating cycle, waste heat from the heat exchanger or flue pipe is utilized to heat a fluid in a radiator system and this heated fluid is then pumped through the coil. In one embodiment of the invention, first and second valves are manipulated to selectively control the flow of condensation and heated fluid through the coil during alternate heating and cooling cycles.

DESCRIPTION OF THE PREFERRED EMBODIMENTS

Figure 1:
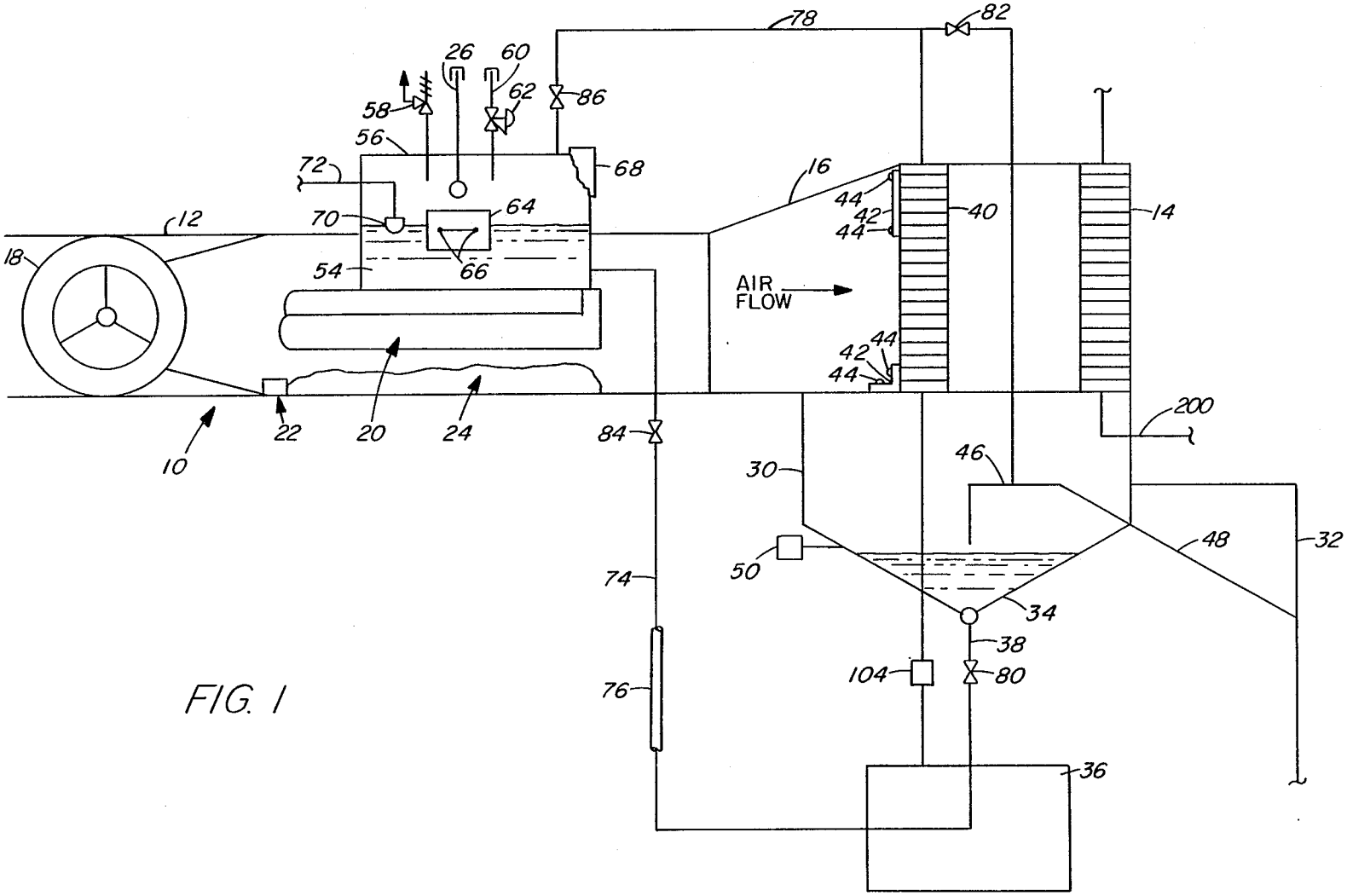
FIG. 1 illustrates a schematic view of the invention.

FIG. 1 illustrates a schematic diagram of the invention. Air handling unit 10 generally comprises furnace 12, evaporator coil 14, transition 16 and blower fan 18. Furnace 12 is illustrated as a gas fired furnace which includes heat exchanger 20, gas valve 22, main burner 24, and flue pipe 26. When main burner 24 is activated, the flame warms heat exchanger 20 and the combustion gases are vented to the ambient surroundings through flue pipe 26. When heat exchanger 20 becomes hot, blower fan 18 is engaged to blow air through heat exchanger 20, past inactive evaporator coil 14, and into the distribution ducts (not shown).

During the cooling cycle, a compressed gas such as Freon is pumped through inlet pipe 200 and expands into evaporator coil 14. The gas chills evaporator coil 14 which then chills the air as it is blown past the inactive heat exchanger 20 and over evaporator coil 14. In a conventional system, evaporator coil operates at about 45 degrees Fahrenheit. During the cooling cycle, moisture in the air condenses on evaporator coil 14 and is collected by a drain pan 30. In a conventional air handling unit, the condensation is piped to a waste plumbing line or to a location outside of the structure. Emergency drain 32 is also utilized to prevent overflow of drain pan 30.

The invention utilizes the condensation to precool the air in air handling unit 10 before the air is in contact with evaporator coil 14. Condensation 34, which is typically cooled to about 55 degrees Fahrenheit, is collected by a fluid collection system which includes drain pan 30. Condensation 34 is circulated by pump 36 which is connected in-line, together with filter 38 between drain pan 30 and coil 40. Filter 38 removes impurities from interfering with the operation of pump 36 to prevent impurities from interfering with the operation of pump 36. Coil 40 is preferably located in the transition 16 between furnace 12 and evaporator coil 14. Coil 40 is illustrated as a helical coil but can be shaped in any configuration well known in the art. For example, coil 40 can be configured as a radiator having fins which increase the surface area of coil 40 in contact with the moving air. Coil 40 can be attached to transition 16 with brackets 42 and screws 44.

As condensation 34 is pumped through coil 40 condensation 34 is returned to drain pan 30. Fluid diverting system 46 selectively permits condensation 34 to be diverted into drain pan 30 or to drain line 48. If desired, level control 50 can be attached to drain pan 30 to monitor the level of condensation 34. If the amount of condensation from evaporator coil 14 exceeds the desired quantity, diverting system 46 will divert the cycled condensation into drain line 48. If additional condensation is required to prevent pump 36 from pulling a vacuum, diverting system 46 will divert the selected amount of cycled condensation into drain pan 30.

When condensation 34 reaches the desired level in drain pan 30, pump 36 is activated to circulate condensation 34 through coil 40. After condensation 34 is cycled through coil 40, condensation 34 is pumped to diverting system 46. In one embodiment of the invention, diverting system 46 can comprise a copper T fitting or similar device, or it can comprise a valve which is electrically connected t level control 50.

During the heating cycle when evaporator coil 14 is inactive, radiator system 52 uses waste heat from furnace 12 to heat a fluid such a water 54. The heated fluid 54 can then be selectively pumped through coil 40 to heat the air in air handling unit 10. Radiator system 52 includes tank 56 which is located adjacent heat exchanger 20 and flue pipe 26. Tank 56 holds fluid 54 in a location which is proximate to the source of heat. In one embodiment of the invention, tank 56 is preferably welded to heat exchanger 20, and to furnace 12 continuously, to transfer heat to by conduction to heated fluid 54. In other embodiments of the invention pressure relief valve 58 is attached to tank 56 to prevent excess pressure from building within tank 56, vent pipe 60 can be installed to permit air to enter tank 56, and pressure regulator 62 can be connected to vent pipe 62 to prevent the release of steam from the system. Access door 64 is attached with screws 66 to permit access to components of radiator system 52. Tank 56 is covered with insulation 68, and tank 56 is preferably not in contact with flue pipe 26. In one embodiment of the invention, float 70 is located in tank 56 to detect the level of fluid 54. Float 70 can be linked with main water supply 72 to maintain the level of fluid 54 in tank 56 at a selected depth.

Heated fluid 54 is pumped from tank 56 into pipe 74 which is surrounded with pipe insulation 76. In one embodiment of the invention, float 70 can be linked with pump 36 so that pump 36 is turned off if the fluid 54 level in tank 56 becomes too low. Pump 36 circulates heated fluid 54 through coil 40, through return pipe 78, and back into tank 56. As heated fluid 54 circulates through coil 40, the heat is transferred to the air moving through air handling unit 10. Since a percentage of the waste heat is captured and transferred to the air, the cycle period for the main burner 24 will take less time to raise the air temperature to the desired level.

Other embodiments of the invention can be practiced without departing from the scope of the invention. For example, a coil can be dedicated to the cooling cycle and a separate coil and pump (not shown) could be dedicated to the heating cycle. As illustrated in FIG. 1, a single coil 40 and pump 36 can be used during the heating and cooling cycles by adding a control system. For example, first valves 80 and 82 can be positioned to prevent the flow of fluid through drain pan 30 and the fluid collection system when the apparatus is in a heating cycle. Moreover, second valves 84 and 86 can be positioned in pipe 74 and return pipe 78 to prevent the flow of condensation through tank 56 when the apparatus is in a cooling cycle. Accordingly, these first and second valves can be selectively manipulated to convert coil 40 from a heating coil to a cooling coil.

Figure 2:
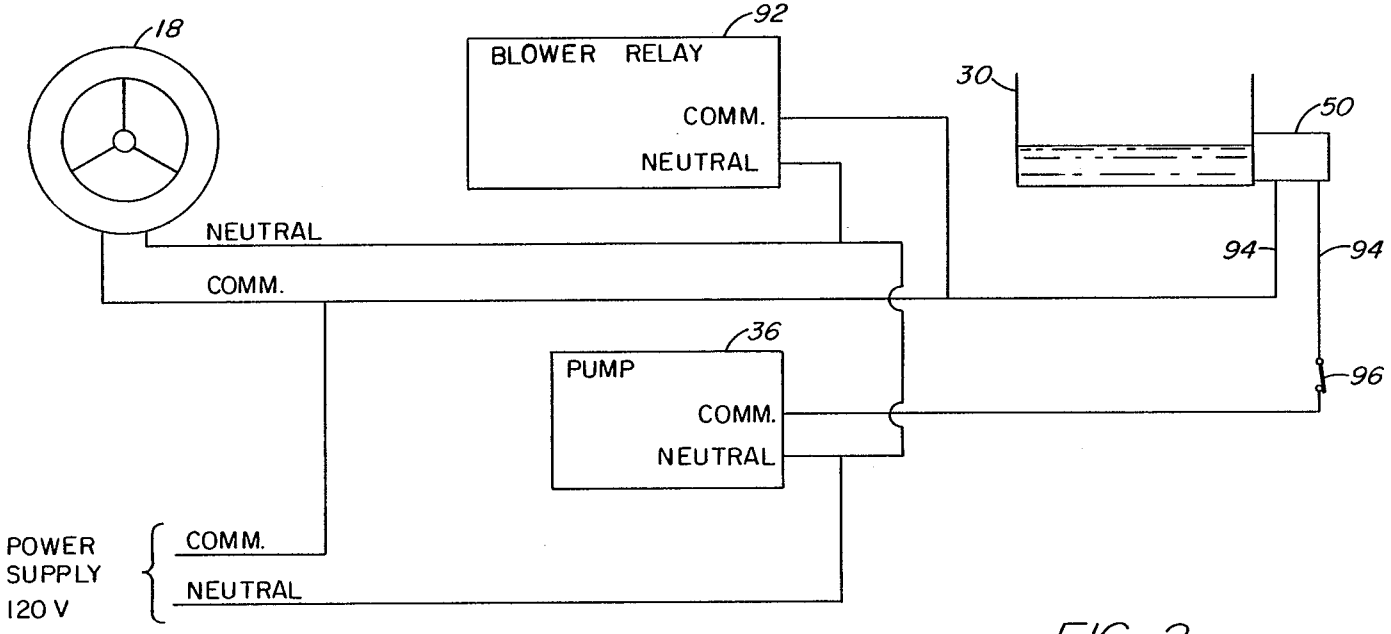
FIG. 2 illustrates a wiring diagram which can be used to control one embodiment of the invention.

Referring to FIG. 2, a wiring diagram for one embodiment of the invention is illustrated. The common lead for power supply 90 is connected to blower fan 18, blower relay 92, and level 94 from level control 50 is connected to pump 36 by an interruptible switch 96. The neutral lead of power supply 90 is connected to blower fan 18, blower relay 92, and pump 36.

Figure 4:
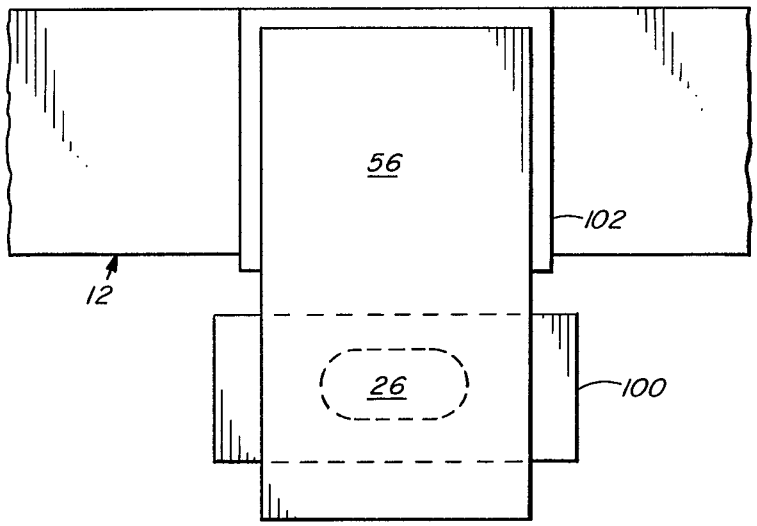
FIG. 4 illustrates a partial plan view of the radiator system and furnace.
Figure 3:
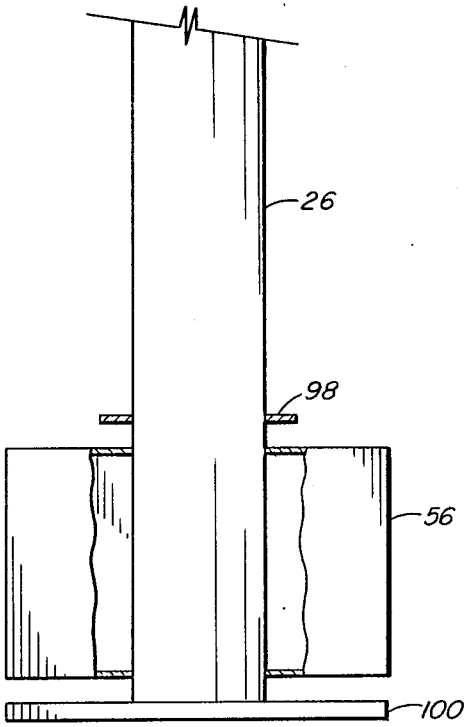
FIG. 3 illustrates a partial side view of radiator system.

Referring to FIG. 3, a sectional side view of tank 56 is illustrated. Flange 98 isolates tank 56 from flue pipe 26 so that flue pipe 26 extends through tank 56 without making contact therewith. Draft diverts 100 funnels the flue gases into flue pipe 26. FIG. 4 illustrates a partial plan view of tank 56 and shows one orientation of flue pipe 26 relative to tank 56. As shown, angle 102 rigidly connected tank 56 to furnace 12.

The method of the present invention is practiced by collecting condensation 34 from evaporator coil 14 during a cooling cycle. Condensation 34 is then pumped through coil 40 to precool the air. During the heating cycle, fluid 54 is heated and is pumped through coil 40 to heat the air. In one embodiment of the invention, a first valve 80 or 82 can be operated to prevent the flow of heated fluid 54 into drain pan 30 during the heating flow of condensation into tank 56 during the cooling cycle. The method can alternatively include the steps of diverting condensation into or away from drain pan 30, of monitoring the level of condensation in drain pan 30 or the level of fluid 54 in tank 56, or the step of adding additional fluid to tank 56.

It will be apparent that many modifications may be made to the foregoing without departing from the scope of the invention. For example backup filter 104 can be added to the system to remove impurities from condensation 34 or fluid 54. Heated fluid 54 can comprise water, liquid sodium or any other fluid which will retain heat. As previously noted, more than one coil can be utilized, however the use of control valves permits the heating and cooling cycles to operate from one pump and one coil. The illustrations and examples used herein should be viewed as illustrative and not in a limiting sense.

What is claimed is:

1. In a system which comprises an evaporator coil, a heat exchanger in a furnace, a flue and a fan for moving air past the evaporator coil and the heat exchanger, an apparatus for conditioning the moving air, said apparatus comprising:

a coil having an exterior surface in contact with the moving air;

a fluid collection system for collecting condensation from the evaporator coil and means for selectively pumping the condensation through said coil; and a radiator system adjacent to the heat exchanger for heating a fluid and having means for selectively pumping the heated fluid through said coil.

2. An apparatus as recited in claim 1, further comprising valves engaged with said fluid collection system and with said radiator system with means for selectively controlling the flow of the condensation and the heated fluid through said coil.

3. An apparatus as recited in claim 2, further comprising a control system for manipulating said valves.

4. An apparatus as recited in claim 3, wherein said control system selectively permits condensation from the evaporator coil to be pumped through said coil when said evaporator coil is engaged in a cooling cycle.

5. An apparatus as recited in claim 3, wherein said control system selectively permits the fluid heated by the radiator system to be pumped through said coil when said heat exchanger is engaged in a heating cycle.

6. An apparatus as recited in claim 1, wherein said coil is helical in shape.

7. An apparatus as recited in claim 1, wherein said coil is configured as a radiator so as to maximize the surface area of said coil in contact with the moving air.

8. An apparatus as recited in claim 1, further comprising a level control for sensing the depth of condensation in said fluid collection system and controlling the level.

9. An apparatus as recited in claim 1, further comprising a filter connected between said fluid collection system and said coil for removing impurities from the condensation.

10. An apparatus as recited in claim 8, further comprising a fluid diverting system connected between said coil and said fluid collection system for selectively diverting condensation from said coil into said fluid collection system.

11. An apparatus as recited in claim 1 wherein said radiator system includes a tank for storing said fluid adjacent to the heat exchanger and next to the flue.

12. An apparatus is recited in claim 11, further comprising a float for detecting the level of the fluid in said tank.

13. An apparatus as recited in claim 11, further comprising a pressure relief valve connected to said tank.

14. In a system which comprises an evaporator coil, a heat exchanger in a furnace, a flue and a fan for moving air past the evaporator coil and the heat exchanger, an apparatus for conditioning the moving air, said apparatus comprising:

a coil having an exterior surface in contact with the moving air;

a fluid collection system for collecting condensation from the evaporator coil and means for selectively pumping the condensation through said coil;

a first valve for selectively permitting the flow of condensation through said coil;

a radiator system adjacent to the heat exchanger for heating a fluid and for selectively pumping the heated fluid through said coil;

a second valve for selectively permitting the flow of the heated fluid through said coil; and control system for manipulating said first and second valves.

15. An apparatus as recited in claim 14, further comprising a level control for sensing the depth of condensation in said fluid collection system and controlling the level.

16. An apparatus as recited in claim 14, further comprising a filter connected between said fluid collection system and said coil for removing impurities from the condensation.

17. An apparatus as recited in claim 15 further comprising a fluid diverting system connected between said coil and said fluid collection system for selectively diverting condensation from said coil into said fluid collection system.

18. An apparatus as recited in claim 14, wherein said radiator system includes a tank for storing said fluid adjacent to the heat exchanger and next to the flue.

19. An apparatus as recited in claim 18, further comprising a float for detecting the level of the fluid in said tank.

20. An apparatus as recited in claim 19, further comprising a supply line linked with said float for maintaining said fluid at a constant level in said tank.

21. An apparatus as recited in claim 18, further comprising a vent connected to said tank for permitting air to enter said tank.

22. A method of conditioning air in a system which comprises an evaporator coil, a water coil, a heat exchanger in a furnace, and a fan for moving air past the evaporator coil, water coil and the heat exchanger, said method comprising the steps of: collecting condensation from the evaporator coil in a fluid collection system when the evaporator coil is engaged in a cooling cycle; pumping the condensation through the water coil; heating a fluid in the tank of a radiator system adjacent to the heat exchanger when the heat exchanger is engaged in a heating cycle; and pumping the heated fluid through the water coil.

23. A method as recited in claim 22, further comprising the step of operating a first valve to selectively permit the flow of condensation through the water coil when the evaporator coil is engaged in a cooling cycle.

24. A method as recited in claim 22 further comprising the step of operating a second valve to selectively permit the flow of the heated fluid through the water coil when the heat exchanger is engaged in a heating cycle.

25. A method as recited in claim 23, further comprising the step of diverting condensation from the water coil to the fluid collection system.

26. A method as recited in claim 25, further comprising the step of monitoring the level of condensation in the fluid collection system.

27. A method as recited in claim 24, further comprising the step of monitoring the level of the heated fluid in the tank of the radiator system.

28. A method as recited in claim 27, further comprising the step of adding additional fluid to the tank of the radiator system.

* * * * *